US012473691B2

(12) United States Patent
Silomaa

(10) Patent No.: US 12,473,691 B2
(45) Date of Patent: Nov. 18, 2025

(54) SLEEVE ROLL BELT

(71) Applicant: Valmet Technologies Oy, Espoo (FI)

(72) Inventor: Tuuli Silomaa, Jyväskylä (FI)

(73) Assignee: Valmet Technologies Oy, Espoo (FI)

( * ) Notice: Subject to any disclaimer, the term of this patent is extended or adjusted under 35 U.S.C. 154(b) by 369 days.

(21) Appl. No.: 18/079,731

(22) Filed: Dec. 12, 2022

(65) Prior Publication Data

US 2023/0183923 A1 Jun. 15, 2023

(30) Foreign Application Priority Data

Dec. 15, 2021 (EP) ..... 21214802

(51) Int. Cl.
*D21F 7/08* (2006.01)
*D02G 3/02* (2006.01)
(Continued)

(52) U.S. Cl.
CPC ..... *D21F 7/08* (2013.01); *D02G 3/02* (2013.01); *D02G 3/447* (2013.01); *D21F 3/0227* (2013.01);
(Continued)

(58) Field of Classification Search
CPC ..... D21F 7/08; D21F 3/0236; D21F 3/0227; D21F 1/0027; D02G 3/02; D02G 3/447; D10B 2101/00; D10B 2201/24; D10B 2331/02; D10B 2331/021; D10B 2331/04; D10B 2401/063; D10B 2505/02
See application file for complete search history.

(56) References Cited

U.S. PATENT DOCUMENTS 4,787,946 A * 11/1988 Romanski ..... D21F 3/0236 156/247
5,062,924 A * 11/1991 McCarten ..... D21F 3/0227 428/167
(Continued)

FOREIGN PATENT DOCUMENTS

EP 4198196 A1 * 6/2023 ..... D02G 3/02
EP 4223927 A1 * 8/2023 ..... D21F 3/0227
(Continued)

OTHER PUBLICATIONS

U.S. Appl. No. 17/956,350, filed Sep. 29, 2022; applicant Vesa-Matti Riihioja, entitled, Modified Polyurethane Belt for a Paper, Board, Pulp or Tissue Machine and Process of Producing Thereof.

*Primary Examiner* — Jose A Fortuna
(74) *Attorney, Agent, or Firm* — Stiennon & Stiennon

(57) ABSTRACT

A sleeve roll belt (10) has an inner surface (11) and an outer surface (12). The belt has a body (15) and a reinforcing structure (30). The reinforcing structure (30) has first yarns (31) arranged to a first direction (D1) of the belt, and second yarns (32) arranged to a second direction (D2) of the belt. The reinforcing structure (30) also has auxiliary yarns (31*b*, 31*c*) arranged parallel or substantially parallel to the first direction (D1) of the belt, wherein the auxiliary yarns are arranged to a depth of greater than a depth of the first yarns, measured from the outer surface (12) of the body (15) to an outer surface (31-*o*, 31*b*-*o*) of each yarn (31, 31*b*, 31*c*) in the depth direction of the belt, and a diameter of the auxiliary yarns is at least 20% smaller than a diameter of the first yarns.

20 Claims, 4 Drawing Sheets

(51) Int. Cl.
*D02G 3/44* (2006.01)
*D21F 3/02* (2006.01)

(52) U.S. Cl.
CPC ..... *D10B 2101/00* (2013.01); *D10B 2201/24* (2013.01); *D10B 2331/02* (2013.01); *D10B 2331/021* (2013.01); *D10B 2331/04* (2013.01); *D10B 2401/063* (2013.01); *D10B 2505/02* (2013.01)

(56) References Cited

U.S. PATENT DOCUMENTS 5,134,010 A * 7/1992 Schiel ..... D21F 3/0236 428/397
5,298,124 A * 3/1994 Eklund ..... D21F 3/0227 442/67
7,524,403 B2 * 4/2009 Fernandes ..... D21F 11/145 100/153
11,619,003 B2 * 4/2023 Poikolainen ..... D21F 3/0227 162/358.4
2010/0243190 A1 * 9/2010 Scherb ..... D21F 1/0072 162/358.3
2021/0363698 A1 * 11/2021 Hagfors ..... D21F 3/0227
2023/0183923 A1 * 6/2023 Silomaa ..... D21F 3/0236 162/358.2

FOREIGN PATENT DOCUMENTS

EP 3913131 B1 * 11/2024 ..... B29D 29/00
JP 7571361 B2 * 10/2024 ..... D02G 3/02
WO WO-0238859 A1 * 5/2002 ..... C08G 18/10
WO WO-2020152392 A1 * 7/2020 ..... B30B 9/247

* cited by examiner

SLEEVE ROLL BELT

CROSS REFERENCES TO RELATED APPLICATIONS

This application claims priority on EP 21214802, filed Dec. 15, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a sleeve roll belt. This invention relates to an arrangement comprising a sleeve roll belt on a sleeve roll.

Paper machines, as well as board, pulp, and tissue machines, are typically equipped with a forming section, a press section, and a drying section. In paper, pulp and board making, it is an issue how to increase the dewatering amount from wet fiber web in order to improve a production efficiency.

Nowadays, these machines typically have felts and wires to remove water from the fiber web. Water can be removed e.g., on the forming section through at least one forming wire.

A sleeve roll can be used e.g., in the forming section to improve dewatering from the web. The sleeve roll needs to have a sleeve roll belt. However, it has been challenging to obtain a belt able to perform well with sleeve rolls.

SUMMARY OF THE INVENTION

The present invention discloses a novel belt for a sleeve roll. A novel arrangement comprises a belt on a sleeve roll.

The object of the present invention is to provide an improved belt for a sleeve roll. Aspects of the invention are characterized by what is stated in the independent claims. Various embodiments of the invention are disclosed in the dependent claims.

The sleeve roll is typically located at a wire section of a paper, board, pulp, or tissue machine. Thanks to the sleeve roll, moisture removal of the wire section can be improved.

The belt according to this specification, i.e., a sleeve roll belt, is suitable for a sleeve roll of a paper, board, pulp, or tissue machine.

The structure of the sleeve roll having a curve element on its outer surface differs e.g., from a structure of a shoe press, hence, properties needed for a sleeve roll belt differs from properties needed e.g., for a shoe press belt. For example, shoe press belts must be able to handle stresses caused by the long nip of the shoe press. The long nip of the shoe press causes high stresses to the belt due to the sharp deflections upon an entrance into and emergence from the pressing zone. The sleeve roll does not have said long nip; hence, the sleeve roll belt does not need to handle that kind of stresses. However, the sleeve roll belt must have suitable properties to handle stresses caused by the curve element of the sleeve roll. Belts used for shoe presses have not been able to perform properly with sleeve rolls. Thus, there has been a need for an improved belt suitable for a sleeve roll.

The curve element, particularly a movable curve element, typically causes a speed difference between the belt and a wire in contact with the belt. The speed difference is problematic because the belt as well as the wire may wear too quickly. Said speed difference can be minimized by controlling locations and properties of yarns so that a location of neutral axis is near the outer surface of the belt. However, by merely shifting the neutral axis of the belt may cause new problems. Yarns near the outer surface may be damaged easier than yarns near the inner surface of the belt. If the yarns near the outer surface are damaged, a strength of the belt may be decreased in an uncontrolled manner, which might cause an unplanned shut down time to the machine. Thus, production efficiency of the machine may be substantially improved by controlling both, the location of the neutral axis of the belt and strength properties of the belt in use.

The location of the neutral axis can depend on the reinforcing structure and particularly on the yarns arranged substantially on the travel direction of the belt. A speed of the belt in a location of first yarns may be controlled to be substantially same as a speed of a wire. However, a speed of the belt on the outer surface of the belt typically differs from a speed of a wire. In order to minimize this speed difference, the first yarns can be arranged near the outer surface of the belt. However, this may cause additional problems as the yarns near the outer surface of the belt may be damaged due to wear of the belt. Thus, the belt may need to be changed to a new one too often, which increases total costs of belts.

The inventors of the present invention have surprisingly found out that it is possible to use auxiliary yarns together with the first yarns. Thanks to the auxiliary yarns, strength of the belt may be maintained in an acceptable level even if the first yarns are damaged, while the auxiliary yarns may not affect too much to the location of the neutral axis of the belt. Therefore, the wear level of the belt (and a wire) may be maintained at a suitable level.

The belt for a sleeve roll can comprise an inner surface and an outer surface. The outer surface can face a fiber web in use. The inner surface can face the sleeve roll in use.

The belt can comprise a body, which is preferably an elastic body, and a reinforcing structure. The reinforcing structure can be a support structure supporting the elastic body.

The reinforcing structure can comprise first yarns and second yarns. The first yarns are arranged to a first direction of the belt, and the second yarns are arranged to a second direction of the belt.

The first direction may be parallel or substantially parallel to a travel direction of the belt.

The first yarns of the belt are preferably near the outer surface of the belt. The first yarns may be the outermost yarns closest to the outer surface of the belt.

The technical effect is that the neutral axis of the belt can be near the outer surface of the belt. This can significantly reduce wear of the belt and provide a longer life for the belt.

The second direction can be perpendicular or substantially perpendicular to the first direction. Further, the second direction may be parallel or substantially parallel to an axis of rotation of the belt.

The reinforcing structure of the belt further comprises auxiliary yarns. The auxiliary yarns can be arranged to parallel or substantially parallel to the first direction of the belt. Thus, the auxiliary yarns may be arranged parallel or substantially parallel to the first yarns. Further, the auxiliary yarns may be arranged parallel or substantially parallel to the travel direction of the belt.

The auxiliary yarns can be thinner than the first yarns. For example, if a diameter of the auxiliary yarns is smaller than a diameter of the first yarns, the auxiliary yarns may be more flexible than the first yarns. The auxiliary yarns can have a diameter that is at least 20% smaller, preferably equal to or more than 30% smaller than a diameter of the first yarns. Thus, the auxiliary yarns may be able to provide suitable strength for at least a predetermined time, but they may not affect too much to the neutral axis of the belt. Still further, thanks to the decreased diameter, the auxiliary yarns can be cost-efficient, environmentally friendly solution.

The diameter of the first yarns may be in a range between 0.3 mm and 3 mm. Further, the diameter of the auxiliary yarns may be in a range between 0.1 mm and 1.5 mm, preferably in a range between 0.3 mm and 1.0 mm.

The first yarns may be arranged to a depth of equal to or less than 3 mm, measured from an outer surface of the elastic body to a bottom of the first yarn in the depth direction of the belt. Thus, the first yarns of the first yarn layer can be arranged partially or fully into the elastic body. Thus, the first yarns may be fully surrounded by the material of the elastic body.

Advantageously, the first yarns are arranged to a depth of less than 2.0 mm, more preferably equal to or less than 1.5 mm, or equal to or less than 0.8 mm, and most preferably to a depth of at least 0.5 mm, measured from the outer surface of the elastic body to the outer surface of each first yarn in the depth direction of the belt.

The technical effect is to provide the neutral axis of the belt near the outer surface of the belt so that wear of the belt can be reduced. This can result a longer life of the belt compared to other belts. Furthermore, the body material can protect the yarns from damage.

The auxiliary yarns may be arranged into the belt so that they are in a depth of at least 10% greater, preferably at least 20% greater than a depth of the first yarns, determined from an outer surface of each yarn, in the depth direction of the belt. Therefore, the auxiliary yarns may be able to maintain a strength of the belt in the travel direction of the belt in an acceptable level even if the first yarns are damaged. Furthermore, a diameter of each auxiliary yarn can be smaller than a diameter of each first yarn, hence, a wear level of the belt (and a wire) may be maintained at a suitable level.

The auxiliary yarns can be fully surrounded by the material of the body. The auxiliary yarns may be arranged to a depth of equal to or less than 2 mm, preferably equal to or less than 1.5 mm, measured from an outer surface of the elastic body to a bottom of the auxiliary yarn in the depth direction of the belt. The technical effect is to provide the neutral axis of the belt near the outer surface of the belt so that wear of the belt can be reduced.

The auxiliary yarns can be arranged to a depth of equal to or more than the depth of the first yarns, measured from the outer surface of the body to a central point of each yarn in the depth direction of the belt.

Advantageously, the auxiliary yarns are arranged to a depth of at least 0.1 mm greater, more preferably equal to or more than 0.3 mm greater, and most preferably equal to or more than 0.5 mm greater than the depth of the first yarns, measured from the outer surface of each first yarn to the outer surface of each auxiliary yarn in the depth direction of the belt. The technical effect is that the auxiliary yarns can maintain strength of the belt in a suitable level longer time after the first yarns are harmed in use. Further, the auxiliary yarns can be arranged to a depth of less than 1.2 mm greater, more preferably less than 1.0 mm greater, and most preferably less than 0.8 mm greater than the depth of the first yarns, measured from the outer surface of each first yarn to the outer surface of each auxiliary yarn in the depth direction of the belt. The technical effect is to maintain the neutral axis of the belt near the outer surface of the belt so that wear of the belt can be reduced. This may result a longer life of the belt compared to other belts.

The auxiliary yarns may be arranged to a depth that is at least 10% greater, preferably at least 20% greater, and most preferably at least 30% greater than a depth of the first yarns, measured from the outer surface of the elastic body to an outer surface of each yarn in the depth direction of the belt.

Advantageously, the auxiliary yarns are arranged into a depth that depends on a diameter of the first yarns. A depth difference between each first yarn and each auxiliary yarn may be in a range between 30% and 100% of the diameter of the first yarn, preferably in a range between 40% and 90% of the diameter of the first yarn, and more preferably in a range between 40% and 80% of the diameter of the first yarn, wherein the depth difference is determined from the outer surface of each first yarn to the outer surface of each auxiliary yarn in the depth direction of the belt. The technical effect is that the auxiliary yarns can maintain strength of the belt in a suitable level after the first yarns are harmed in use. Further, neutral axis can be maintained near the outer surface of the belt so that wear of the belt can be reduced. This can result a longer life of the belt compared to other belts.

A number of the auxiliary yarns, measured in a direction perpendicular to the direction of the auxiliary yarns, may be in a range between 200 yarns/m and 800 yarns/m. The number of the auxiliary yarns per meter may be from 0.5 to 3 times the number of the first yarns per meter, preferably from 1 to 2 times the number of the first yarns per meter. Therefore, the belt can have good stretching and strength properties for the sleeve roll, even after the first yarns are harmed.

The auxiliary yarns can be arranged to provide to the belt, without the first yarns, a breaking strength equal to or more than 50 kN/m, measured in the travel direction of the belt. The technical effect is that the belt can have suitable strength for a sleeve roll in the travel direction of the sleeve roll belt even after the first yarns are broken.

Thus, the belt can have a breaking strength equal to or more than 50 kN/m, preferably in a range between 70 kN/m and 200 kN/m, measured without the first yarns in the travel direction of the belt.

The auxiliary yarns may comprise or consist of at least one of:

polyamide (PA),
aromatic polyamide,
rayon,
polyester, preferably polyethylene terephthalate (PET),
polyethylene naphthalate (PEN), and
carbon/thermoplastic composite.

These materials can be used to provide sufficient strength properties and dimensional stability for the auxiliary yarns. Preferably, the auxiliary yarns comprise or consist of polyester, preferably polyethylene terephthalate (PET). Thus, dimensional stability of the auxiliary yarns can be in an improved level.

For environmental reasons, the auxiliary yarns may comprise or be made of biopolymer(s). Alternatively, or in addition, the auxiliary yarns may comprise or be made of recycled polymer(s).

The sleeve roll belt can be arranged to have at least one, preferably at least two, and most preferably all of the following properties: the belt is configured to stretch elastically at least 1.5% in the travel direction of the belt, preferably in a range between 1.8% and 3.0% in the travel direction of the belt so that it will return in its original length after forces stretching the belt has been removed, a load at specific elongation of 2% (LASE 2%) in the travel direction of the belt is equal to or more than 28 kN/m and preferably equal to or less than 50 kN/m, a load at specific elongation of 4% (LASE 4%) in the travel direction of the belt is equal to or more than 49 kN/m and preferably equal to or less than 80 kN/m, the belt is configured to return in its original length after a load of 25 kN/m stretching the belt in the travel direction of the belt has been removed, preferably the belt is configured to return in its original length after a load of 30 kN/m stretching the belt in the travel direction of the belt has been removed, and the belt has a tensile elongation at break of equal to or more than 20%, such as between 20 and 25%, measured at a temperature of 20° C. in the travel direction of the belt.

Thus, the belt may have improved properties for the sleeve roll.

Thanks to the novel solution, an improved sleeve roll belt can be obtained. The novel reinforcing structure comprises auxiliary yarns, which auxiliary yarns may be thinner than the first yarns.

The novel sleeve roll belt may have suitable strength even if the first yarns have been broken. Furthermore, the neutral axis of the belt can be near the outer surface of the belt. Therefore, wear of the belt may be reduced. Furthermore, because speed difference between the belt and a wire in contact with the belt may be reduced, wear of the wire may also be reduced.

BRIEF DESCRIPTION OF THE DRAWINGS

The figures are illustrations which may not be in scale. Similar parts are indicated in the figures by the same reference numbers.

DESCRIPTION OF THE PREFERRED EMBODIMENTS

Figure 1A:
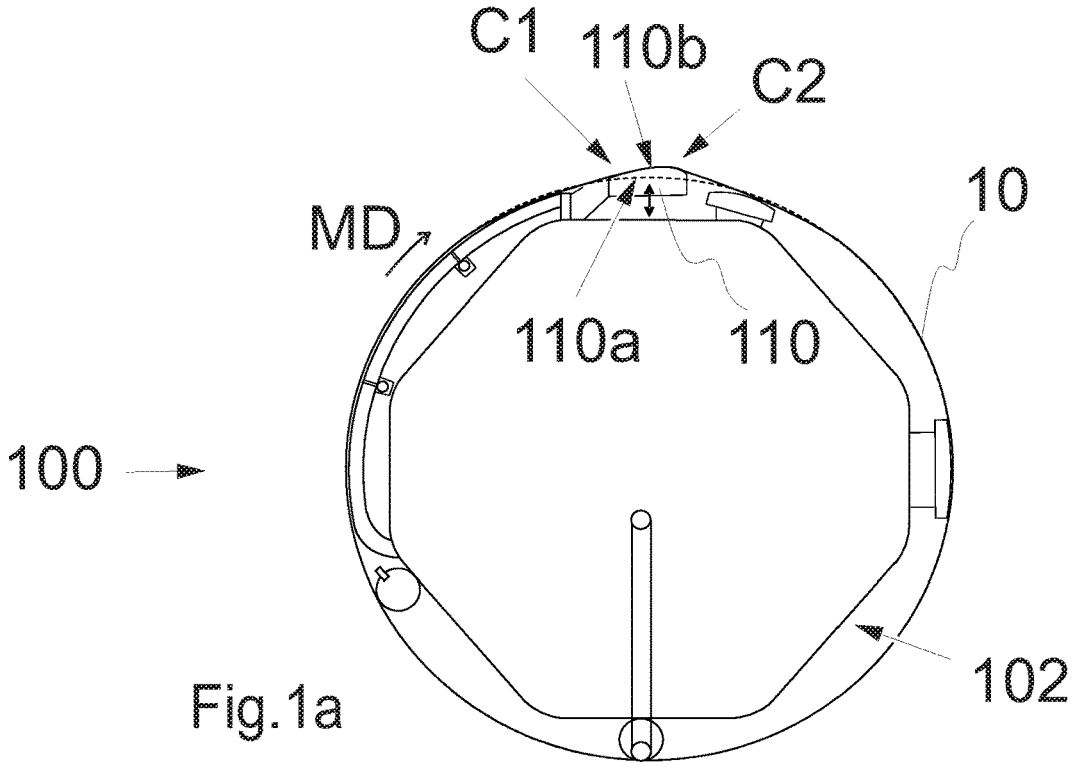
FIGS. 1*a-b* illustrate examples of a sleeve roll.

All embodiments in this application are presented as illustrative examples, and they should not be considered limiting.

Terms

In this application, the terms "belt" and "sleeve roll belt" refer to a belt suitable for a sleeve roll, unless otherwise stated. The sleeve roll belt 10 may be suitable for a sleeve roll of a paper machine. The sleeve roll belt 10 may be suitable for a board, pulp, or tissue machine. The sleeve roll belt 10 can be arranged on a sleeve roll 100 which can be located e.g., at a wire section of a paper, board, pulp, or tissue machine. The sleeve roll belt can be used to improve water removal from very wet fiber web in the wire section. The sleeve roll belt 10 can be an impermeable belt.

In this application, the term "yarn" refers to a long structure, which has relatively small cross section. The yarn can be composed of fibers and/or filaments, with or without twist. The yarn can be multiple plied yarn. The yarn can be based on synthetic polymer(s). The term "filament" refers to a fiber of great length.

The terms "first yarn layer" and "first yarns" refer to yarns which are arranged in a first direction.

The terms "second yarn layer" and "second yarns" refer to yarns which are arranged in a second direction.

Thus, in this application, the term "first direction" D1 refers to a direction to which the first yarns are arranged. Further, the term "second direction" D2 refers to a direction to which the second yarns are arranged. The first direction is preferably parallel or substantially parallel to the travel direction of the belt. The second direction is preferably parallel or substantially parallel to the cross direction of the belt.

The term "travel direction" MD refers to the direction of rotation of the sleeve roll belt in use. The term "cross-direction" CD refers to the longitudinal direction, typically transverse to the travel direction MD of the belt 10. In use, the cross-direction is parallel to the axis of rotation of the sleeve roll belt. Thus, the cross direction refers to a direction parallel to the axis of rotation of the sleeve roll belt in use.

The first yarns may be arranged substantially parallel to the travel direction of the sleeve roll belt. The second yarns may be arranged substantially parallel to the cross direction of the sleeve roll belt.

In this application, the term "substantially parallel" means that one direction does not deviate from said substantially parallel direction by more than 10 degrees, more advantageously not by more than 5 degrees, and most preferably not by more than 3 degrees. Thus, e.g., "substantially parallel to the travel direction" means, in this application, that a direction does not deviate from said travel direction by more than 10 degrees, more advantageously not by more than 5 degrees, and preferably not by more than 3 degrees. Furthermore, e.g., "substantially parallel to the cross-direction" means, in this application, that a direction does not deviate from said cross-direction by more than 10 degrees, more advantageously not by more than 5 degrees, and preferably not by more than 3 degrees.

In this specification, the term "elasticity" refers to an ability of the belt to return to its original shape after stretching or pressing, i.e., when a force is removed. Elasticity percentages (%) are values stating how much the belt can stretch elastically.

A load at specific elongation (LASE) refers to the load needed for the determined elongation, i.e., load applied for a specified elongation. For example, LASE 2% is a value defined as a measured load when the elongation is 2%. The load at specific elongation is determined based on the standard SFS 2983. The values can be determined by using Alwetron TCT 20 device from Lorentzen & Wettre AB (Lorentzen & Wettre, Sweden).

In addition, a term EASF is used in this technical field, referring to an elongation at specific force. EASF may be used for similar purposes as LASE, but EASF (elongation at specific force) is not the same as LASE (load at specific elongation).

A breaking strength can be determined based on the standard SFS 2983. The values can be determined by using Alwetron TCT 20 device from Lorentzen & Wettre AB (Lorentzen & Wettre, Sweden).

Furthermore, the term thickness of the belt will be used, referring to the depth direction of the belt.

Paper, Board, Pulp, and Tissue Machines

Typically, in paper, board, pulp and tissue machines, the fiber web is produced and treated in an assembly formed by several apparatuses arranged consecutively in a process line. A typical production line comprises a forming section comprising a headbox and a wire, a press section, a drying section and, finally, a reel-up. Further, the production line typically comprises e.g., at least one winder for forming customer rolls.

In the forming section, a headbox is typically used to form the fiber web. Further, some water can be removed through at least one forming wire. The sleeve roll 100 can be located in the forming section for improving water removal therein. The present invention relates to a belt 10 for a sleeve roll 100.

Sleeve Roll

Figure 1B:
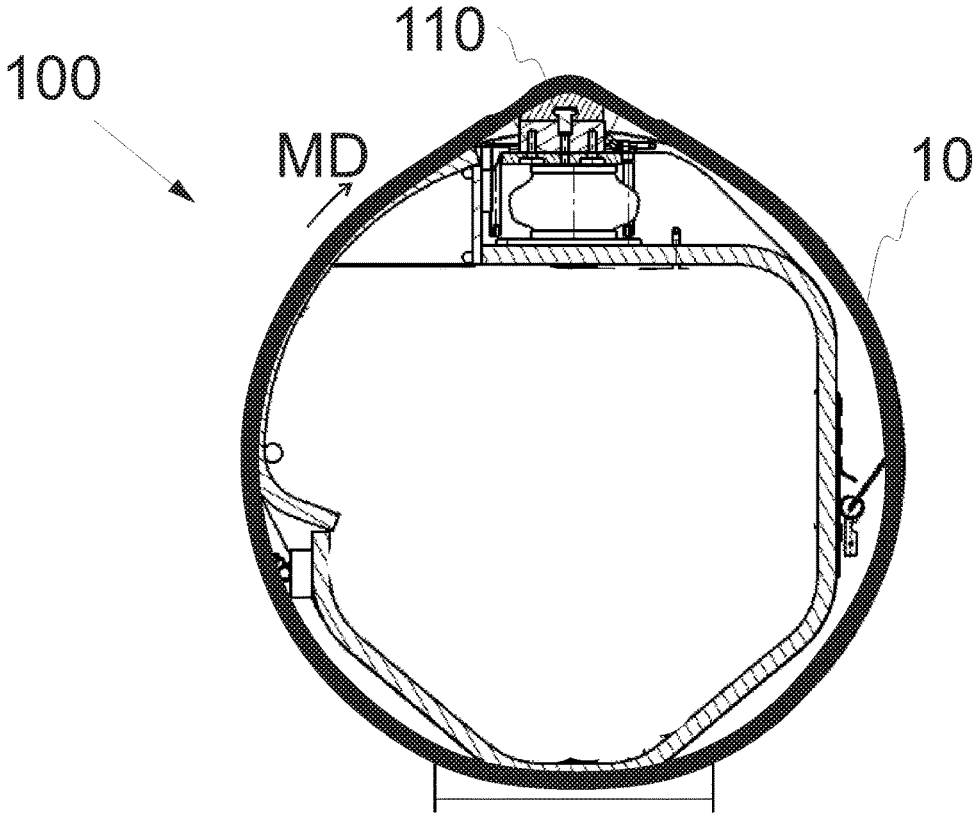
Figure 2:
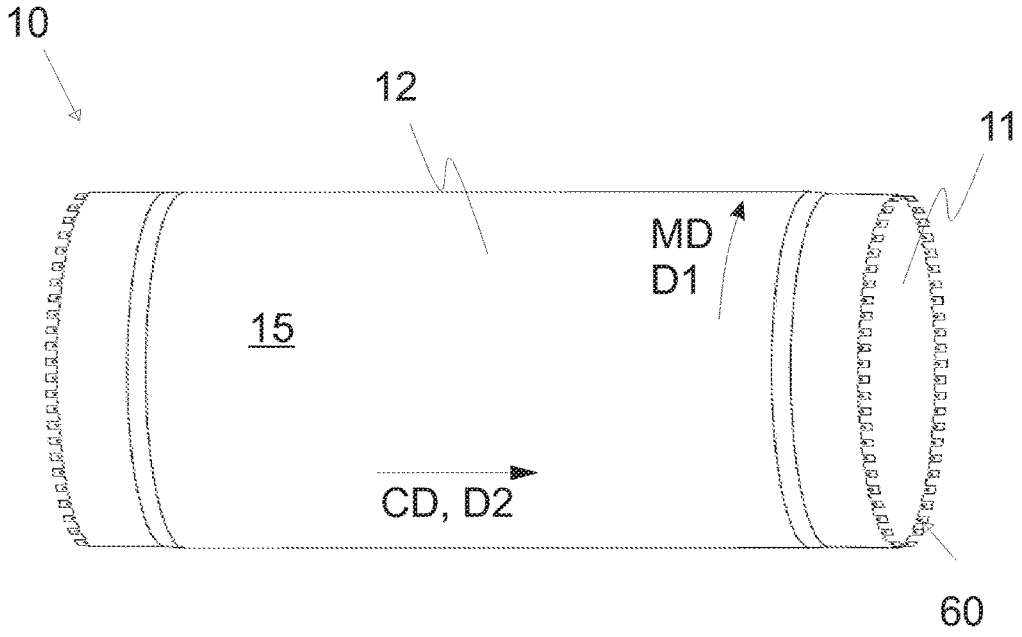
FIG. 2 shows an example of a belt.

Referring to FIGS. 1 *a-b*, a sleeve roll 100 can comprise a curve element 110 and a support shaft 102.

In operation, the sleeve roll belt typically runs through the dewatering zone on the curve element. The curve element 110 can cause increased forces which stretch the sleeve roll belt on the curve element 110. The curve element 110 can be movable, i.e., a radius of curvature of the sleeve roll belt on the on the surface of the curve element 110 can be controlled by moving the curve element 110 towards the center of the sleeve roll or outward from the outer surface of the sleeve roll. Thus, stretching of the sleeve roll belt 10 may vary from a normal rate to a high rate.

The sleeve roll 100 further comprises the sleeve roll belt 10 which is typically located around an outer surface the sleeve roll 100. The sleeve roll belt 10 can be led to circle around the support shaft 102.

Further, the sleeve roll 100 may comprise support elements located at a distance from each other on the support shaft 102. The sleeve roll belt 10, which can circle around the outer surface of the sleeve roll, can be supported by the support elements.

The sleeve roll belt 10 is or can be arranged in connection with the sleeve roll 100 in such a way that its outer surface 12 can face a fiber web and its inner surface 11 faces the sleeve roll. Thus, the sleeve roll 100 can be encircled by the sleeve roll belt 10 having the shape of a loop.

A circumference of the sleeve roll belt may be increased and decreased during operating hours of the belt due to the movable curve element 110. Therefore, the sleeve roll belt may have high elasticity in order to be able to handle the stretching caused by the curve element 110 of the sleeve roll. Further, the sleeve roll belt may have good strength properties so that it does not break easily.

The sleeve roll 100 can comprise at least one curvilinear dewatering zone C1, C2 comprising typically at least two partial curves C1, C2 such that the radius of curvature of a first partial curve C1 may be greater than the radius of curvature of a second partial curve C2 following the first partial curve in the travel direction MD of the sleeve roll belt. This can improve the water removal from the fiber web.

The curvilinear dewatering zone C1, C2 may be formed by the curve element 110 of the sleeve roll 100. The degree of curvature of the curve element 110 can increase in the travel direction of the belt 10 such that increasing dewatering pressure is applied to the fiber web travelling between the wires on said at least one curvilinear dewatering zone C1, C2 on the curve element 110. The curvilinear dewatering zone C1, C2 on the curve element 110 may contain several curves such that the radius of curvatures preferably decreases in the running direction of the wires. This can improve the water removal from the fiber web.

The sleeve roll 100 can comprise lubricant between the inner surface 11 of the sleeve roll belt 10 and the outer surface of the sleeve roll 100. Thus, the sleeve roll can comprise e.g., a lubricating pump(s), which can be used to pump lubricant into a gap between said belt 10 and the outer surface of the sleeve roll.

The curve element 110 may be moved between two or more than two positions. Therefore, the curve element 110 may be used for controlling the radius of curvature of the belt 10 on the curve element 110.

The first position of the curve element 110 may form a first surface 110*a* on the curve element. The first surface 110*a* may have the same radius of curvature as the surface near the curve element.

In the second position of the curve element 110, an outer surface of the curve element may be moved outward. Thus, the second position of the curve element 110 may form a second surface 110*b* on the curve element. The second surface 110*b* may have decreased radius of curvature, if compared to surfaces near the curve element.

In the second position of the curve element 110, the sleeve roll belt 10 may need to stretch due to the curve element 110. Further, if the curve element 100 is movable, the sleeve roll belt 10 may need to return to its original shape when the curve element is moved back to the first position. Thus, the sleeve roll belt 10 may need to have good elasticity as well as suitable strength properties.

As discussed above, the sleeve roll belt 10 can be arranged to run around the sleeve roll 100. The inner surface 11 of the sleeve roll belt 10 can slide against the outer surface of the sleeve roll 100. A fiber web to be treated can be led to the sleeve roll belt 10, typically supported by one or more than one fabric, such as a wire. Thus, wire(s) can be led via the curvilinear dewatering zone C1, C2, which dewatering zone can be supported by the sleeve roll belt 10.

Sleeve Roll Belt

The sleeve roll belt 10 is fitted or is intended to be fitted in a target, such as on a sleeve roll in a wire section of a paper machine.

The belt 10 has a length, a circumference, and a thickness. The thickness is the smallest dimension. The circumference and the length can be selected for adapting the belt to a sleeve roll 100. The circumference of the sleeve roll belt 10 is determined to be such that the inner diameter of the sleeve roll belt 10, when in operation, will be suitable for the sleeve roll.

The length of the belt in the cross direction is determined according to the machine width and may be, for example, in a range between 1.5 m and 12.6 m.

The circumference of the sleeve roll belt 10, that is, the length of one rotation, may be equal to or more than 2.2 m, for example equal to or more than 3.0 m, or equal to or more than 3.4 m. Furthermore, the circumference of the belt 10 is preferably not greater than 6.3 m, for example equal to or less than 6.0 m, or equal to or less than 5.8 m.

The thickness of the sleeve roll belt can be at least 2 mm, more preferably at least 2.5 mm, and most preferably at least 3 mm. Thus, it is possible to arrange at least some yarns into the belt. Furthermore, the thickness of the sleeve roll belt can be equal or less than 7 mm, more preferably equal to or less than 5 mm, and most preferably equal to or less than 4 mm, for example in a range of 2.5 mm-5 mm. This thickness can be particularly suitable for sleeve rolls having auxiliary yarns. Further, said thickness together with materials and a reinforcing structure of the belt can provide good strength properties for the sleeve roll belt.

The outer surface 12 of the sleeve roll belt can be smooth, or at least substantially smooth, as shown in FIGS. 3*a-d*. Thus, the outer surface 12 of the sleeve roll belt can be without, e.g., grooves. The belt having the smooth outer surface may not have grooves, nor patterning, having a depth of more than 0.4 mm. Particularly, a smooth surface may not have any area of greater than 10 $mm^2$ having a depth of more than 0.4 mm.

Deviations on the outer surface 12 of the belt 10 may be e.g., less than 0.3 mm, such as equal to or less than 0.2 mm. Thus, the smoothness of the outer surface 12 may be improved. Furthermore, thanks to the smooth or at least substantially smooth outer surface 12, the first yarns may be arranged near the outer surface 12 of the belt. Therefore, properties of the sleeve roll belt can be improved so that the surface wear of the belt and a wire therein may be reduced.

The outer surface 12 of the sleeve roll belt can comprise a slight patterning, i.e., so-called buffing. The depth of the buffing on the outer surface 12 of the sleeve roll belt 10 may be, for example, 0 to 100 μm, preferably from 0.01 μm to 50 μm. A suitable roughness of the outer surface of the sleeve roll belt may have advantageous effects on its action together with a paper machine fabric, particularly with a wire.

By arranging the first yarns 31 near the surface of the belt, wear of the belt may be reduced. Thanks to the auxiliary yarns 31*b*, 31*c* providing sufficient strength after the first yarns are harmed, it may be possible to arrange the first yarns 31 near the outer surface of the belt.

The inner surface 11 of the sleeve roll belt can be substantially smooth. The sleeve roll belt 10 may or may not comprise a pattern on the inner surface 11 of the belt 10. The inner surface 11 may comprise a slight patterning, i.e., so-called buffing. The depth of the buffing may be, for example, 0 to 40 μm, preferably from 0.05 μm to 10 μm. Said roughness of the inner surface of the belt may have a substantial effect on the durability of the sleeve roll belt. For example, the combination of the outer surface of the sleeve roll 100 and the rough inner surface 11 of the belt 10 would not be as sensitive to decelerate as the combination of the smooth metal surface of the sleeve roll 100 and the smooth inner surface 11 of the sleeve roll belt, particularly in a case of broken uniformity of the lubricating oil film. In such a situation, the sleeve roll belt having an inner surface 11 with a buffing may not be as easily damaged as a belt having a smooth inner surface.

The belt 10 can be bendable, i.e., the belt can be capable of being bent at least to a predetermined radius of curvature without breaking. The predetermined radius of curvature can be smaller than radius of curvature of the surface of the curve element 110, in any position of the curve element 110. Therefore, the belt may not be easily damaged.

The sleeve roll belt can be configured to have a breaking strength of equal to or more than 100 kN/m, preferably equal to or more than 140 kN/m, and most preferably equal to or more than 160 kN/m, such as from 170 kN/m to 230 kN/m, measured in the travel direction of the sleeve roll belt. Thus, the belt may not be easily damaged even in special cases e.g., due to an emergency stop of a machine, or if there is not much oil between the outer surface of the sleeve roll 100 and the inner surface 11 of the sleeve roll belt e.g., due to starting of the sleeve roll after a machine downtime. Further, the breaking strength of the belt may be smaller than a breaking strength of the sleeve roll in order to protect the sleeve roll. Still further, said breaking strength of the belt may provide good elasticity for the sleeve roll belt.

Furthermore, the sleeve roll belt can be configured to have a breaking strength of equal to or more than 50 kN/m, preferably equal to or more than 60 kN/m, and more preferably equal to or more than 70 kN/m, such as from 70 kN/m to 200 kN/m, measured in the travel direction of the sleeve roll belt, determined without the first yarns. Thus, the belt may not be damaged when the first yarns have been broken e.g., due to wear of the belt. Further, said breaking strength of the belt may be smaller than a breaking strength of the sleeve roll in order to protect the sleeve roll.

A load at specific elongation (LASE) as well as breaking strength can be determined based on the standard SFS 2983. The values can be determined by using Alwetron TCT 20 device from Lorentzen & Wettre AB (Lorentzen & Wettre, Sweden). A constant rate of elongation (CRE) is used while determining test values. The application of load is made in such a way that the rate of elongation of the sample is kept constant. A computerized control system can be used to maintain constant force. The elongation rate applied to the samples is 10 mm/min. During the measurements, a sample between the stationary and the moving clamp is extended by a constant distance per unit of time (10 mm/min) and the force required to do so is measured. The breaking elongation is calculated from the clamp displacement.

The total size of the sample is 240 mm×30-40 mm, wherein the length of the test sample is 240 mm, and the width of the sample is 40 mm in both ends of the sample and 30 mm in the middle of the sample. The width of the sample in contact with the clamp is 40 mm. During measurements, a load of 2 kN±0.1% is used for samples having a maximum load of less than 1.7 kN. Further, a load of 20 kN±0.1% is used for samples having a maximum load equal to or more than 1.7 kN.

The sleeve roll belt can be configured to have a LASE 2% in a range between 28 kN/m and 50 kN/m. The LASE 2% can be equal to or more than 28 kN/m, typically equal to or more than 30 kN/m, and most preferably equal to or more than 35 kN/m, determined in the travel direction of the sleeve roll belt.

Further, the LASE 2% may be equal to or less than 50 kN/m, or equal to or less than 40 kN/m, determined in the travel direction of the sleeve roll belt. Thus, the belt may have a good stretchability level for a sleeve roll belt.

The sleeve roll belt can be configured to have a LASE 4% in a range between 47 kN/m and 80 kN/m. The LASE 4% can be equal to or more than 47 kN/m, typically equal to or more than 50 kN/m, and most preferably equal to or more than 52 kN/m, determined in the travel direction of the sleeve roll belt. Further, the LASE 4% may be less than 80 kN/m, for example equal to or less than 70 kN/m, determined in the travel direction of the sleeve roll belt. The technical effect is that the belt may perform well with high loads and have good stretchability as well as good dimensional stability properties. Further, belts having said specific elongations (LASE 2% and LASE 4%) may have good predictability, i.e., elongations of the belt may be predicted in different stresses.

The sleeve roll belt may be configured to stretch with a force of 30 kN/m in the travel direction of the sleeve roll belt so that it will return in its original length after the force stretching the belt has been removed. Thus, the belt may have good stretchability and elasticity in the travel direction of the belt.

The sleeve roll belt can be configured to stretch equal to or more than 1.5%, such as in a range between 1.5% and at least 3.0%, or from 2.0% to 5.0%, in the travel direction of the belt so that it will return in its original length after the force stretching the belt has been removed. Preferably, the sleeve roll belt can be configured to stretch at least 2.0%, more preferably at least 2.2% in the travel direction of the sleeve roll belt so that it will return in its original length after the force stretching the belt has been removed.

The novel sleeve roll belt can be configured to stretch elastically at least 10% more to the first direction than to the first direction. Advantageously, an elasticity of the belt in the second direction can be least 20% smaller than an elasticity of the belt in the first direction.

The sleeve roll belt, as well as the yarns therein, can be made in manners known per se. The sleeve roll belt may be manufactured, e.g., by providing several yarns;

shaping an elastic body for a sleeve roll belt by casting at least one elastomer material against a mold surface; and curing the frame.

The sleeve roll belt is intended to be installed on a sleeve roll of a board machine, a paper machine, a pulp machine, or a tissue machine, preferably in a wire section therein. The sleeve roll belt may further comprise e.g., plurality of attaching points 60 of the belt for an installation of the belt.

The sleeve roll belt 10 may be shaped like an endless loop.

Body of the Belt

The sleeve roll belt 10 can be made of materials, which are suitable for paper, board, pulp, and tissue machines, which do not harm a wire, and which have suitable stretching and strength properties.

The sleeve roll belt can comprise polymer(s). The body 15 may comprise or consist of elastomer material. The elastomer material is preferably the main raw material of the sleeve roll belt.

The body of the belt may comprise or consist of polyurethane, and/or natural rubber (NR), and/or synthetic rubber (SR).

A total amount of said materials may be at least 50 wt. %, more preferably at least 70 wt. %, and most preferably equal to or more than 80 wt. %, calculated from the total weight of the belt. Thus, the elasticity, and bendability of the belt may be improved. These materials can be used to obtain good strength and elasticity properties for the belt; hence, the belt may be able to stretch and bend during operating hours without breaking. Furthermore, the sleeve roll belt may comprise less than 99.9 wt.-%, more advantageously less than 97 wt.-% and preferably less than 95 wt.-% said materials, calculated from the total weight of the sleeve roll belt. For example, the reinforcing structure typically comprises other material(s).

The body 15 of the belt may comprise polyurethane. Preferably, the body 15 consists of polyurethane or contains primarily polyurethane. Advantageously, the sleeve roll belt comprises at least 50 wt.-%, more advantageously at least 70 wt.-%, and preferably at least 80 wt.-% polyurethane, calculated from the total weight of the sleeve roll belt. Furthermore, the sleeve roll belt may comprise less than 99.9 wt.-%, more advantageously less than 97 wt.-% and preferably less than 95 wt.-% polyurethane, calculated from the total weight of the sleeve roll belt. Polyurethane may improve the properties of the sleeve roll belt, such as elasticity and bendability, and be particularly suitable for use in combination with a sleeve roll 100 having a curve element 110.

Currently, most polyols used in the production of polyurethane are derived from petrochemicals. For environmental reasons, the belt may comprise a polyurethane comprising bio-based components. Preferably, the body of the belt comprises, mainly comprises, or consists of bio-based and/or recycled polyurethane. The bio-based polyurethane may comprise 20 to 100% bio-based component(s).

Reinforcing Structure of the Belt

As discussed, the sleeve roll belt 10 can comprise the reinforcing structure 30 in order to obtain good strength properties. However, the elasticity of the sleeve roll belt may need to be substantially high, hence, the reinforcing structure should not decrease the elasticity of the sleeve roll belt too much.

A curve element 110 of a sleeve roll 100 may cause high stress to the sleeve roll belt. Thus, the sleeve roll belt 10 may need to have suitable reinforcing structure. However, due to the curve element 110 which typically forces the sleeve roll belt to stretch and/or compress, the sleeve roll belt may need to have both; good strength as well as good elasticity. Conventionally, it has been challenging to obtain a belt for sleeve rolls, because such a belt may need to have a reinforcing structure providing good strength properties for the belt without preventing stretching of the belt on the curve element 110. The stretching level of the belt can be controlled by the reinforcing structure 30 of the sleeve roll belt.

The novel sleeve roll belt may have good strength properties as well as suitable elasticity and ability to stretch. The reinforcing structure 30 of the sleeve roll belt may comprise yarns which are arranged into the belt so that the material of the elastic body surrounds the yards. The belt may comprise yarns which are arranged near the outer surface of the belt.

The reinforcing structure 30 can be a support structure of the belt formed by the yarns 31, 31*b*, 31*c*, 32. FIGS. 3*a-d* and 4 illustrate example structures of the belt 10 comprising a body 15, first yarns 31, second yarns 32 and auxiliary yarns 31*b*, 31*c*. The belt may comprise the material of the body 15 between the adjacent yarns 31, 31*b*, 31*c*, 32.

The yarns 31, 32, 31*b*, 31*c* are preferably arranged in layers within the elastic body 15. The reinforcing structure 30 may provide suitable strength properties for the sleeve roll belt as well as an ability to return its original shape after the stretching caused by the curve element 110.

The reinforcing structure 30 can comprise first yarns 31 which are arranged in the first direction D1, and auxiliary yarns 31*b*, 31*c* which are arranged at least substantially in the first direction D1. The reinforcing structure 30 can further comprise second yarns 32, which are arranged in the second direction D2.

The second yarns 32 can be arranged perpendicular or substantially perpendicular to the first yarns 31. Furthermore, the second yarns 32 can be arranged perpendicular or substantially perpendicular to the auxiliary yarns 31*b*, 31*c*. The technical effect is to provide good strength properties to the travel and cross directions of the sleeve roll belt. In an embodiment, the first yarns and the auxiliary yarns form a first yarn layer, and the second yarns form a second yarn layer. Thus, in an embodiment, a total of two reinforcing yarn layers 31, 31*b*, 31*c*, 32 are provided.

Thus, as discussed, the reinforcing structure 30 of the sleeve roll belt 10 can comprise the second yarns 32 arranged to the second direction D2. An angle between the second yarns 32 and the cross-direction CD is preferably less than 15°, more preferably less than 10°, and most preferably less than 5°. The second direction can be parallel or substantially parallel to the cross-direction CD of the sleeve roll belt. The second yarns 32 may not need to have high stretchability because the belt does not substantially stretch to the cross direction. Thus, the elasticity of the second yarns 32 can be smaller than elasticity of the first yarns 31. However, the second yarns 32 may need to have good strength. The technical effect of the second yarns 32 may be to improve the dimensional stability of the sleeve roll belt in the cross direction.

The first direction D1 can be parallel or substantially parallel to the travel direction MD of the sleeve roll belt. An angle between the first yarns 31 and the travel direction MD of the belt is preferably less than 15°, more preferably less than 10°, and most preferably less than 5°. Thus, it can be possible to form good reinforcing structure for the travel direction of the sleeve roll belt 10. The first yarns 31 may have high stretchability so that they may perform well with the curve element 110 of the sleeve roll. Further, the first yarns may have good strength properties. Thus, the first yarns 31 may provide good stretchability and/or elasticity for the support structure of the belt as well as sufficient strength for the belt in the travel direction of the belt.

Advantageously, the first yarns 31 and the auxiliary yarns 31*b*, 31*c* are arranged substantially perpendicular to the second yarns 32. An angle between the first yarns and the second yarns is preferably around 900 such as in a range between 80° and 100°. Furthermore, an angle between the auxiliary yarns and the second yarns is preferably around 900 such as in a range between 80° and 100°.

Advantageously, the reinforcement structure consists of said first, second and auxiliary yarns.

The second yarns 32 can be arranged adjacent to each other at a distance from each other in such a manner that the elastic body material is settled around the yarns 32.

The first yarns 31 can be arranged adjacent to each other at a distance from each other in such a manner that the elastic body material is settled around the yarns. Furthermore, the auxiliary yarns can be arranged between the first yarns and/or below the first yarns.

The yarns in different layers may be either in contact with or bonded to the yarns of the next layer, or they may be spaced from each other. Preferably, the reinforcing yarn layers on top of each other are separated from each other. Thus, the yarn layers do not have to be fastened to each other or bound to each other in any way. Further, adjacent yarns do not have to be fastened to each other or bound to each other in any way.

Advantageously, the reinforcing structure 30 comprises yarns arranged in two layers inside the elastic body 15, which layers are arranged substantially perpendicular to each other. The first yarn layer can comprise or consist of first yarns and auxiliary yarns. The second yarn layer can comprise or consist of second yarns.

The first yarns and the auxiliary yarns can be arranged above the second yarn layer e.g., at a small distance from the second yarn layer. The first yarns and the auxiliary yarns can be arranged from 0 mm to 2.0 mm, preferably from 0.2 mm to 1.0 mm above the second yarns.

The reinforcing yarns may be separate yarns adjacent to each other, or they may be, e.g., formed of—one or more yarns placed spirally in parallel. The adjacent reinforcing yarns may be spaced apart by, for example, 0.5 to 3 mm so that the area between the reinforcing yarns preferably comprises or consists of the elastic body material.

The second yarn layer can be the innermost yarn layer closest to the inner surface 11 of the sleeve roll belt 10. The second yarn layer can consist of separate yarns. Thus, the adjacent yarns can be spaced from each other. Preferably, the second yarns are spaced evenly or substantially evenly. Thus, each second yarn can be arranged to be spaced apart by equal distances from adjacent yarns. The adjacent second yarns may be spaced apart by e.g., from 0.5 to 3.5 mm. The area between the adjacent second yarns preferably consist of the elastic body material.

The first yarn layer can consist of separate yarns. Thus, the adjacent yarns can be spaced from each other. Preferably, the first yarns are spaced evenly or substantially evenly. Thus, each first yarn can be arranged to be spaced apart by equal distances from adjacent yarns. The adjacent first yarns may be spaced apart by e.g., from 0.5 to 3.5 mm. The area between the adjacent first yarns may consist of the elastic body material and the auxiliary yarns.

The first and second yarns may be equal or different in thickness. Preferably, the second yarns are substantially equal in thickness with each other. Further, the first yarns are preferably substantially equal in thickness with each other. The first yarns may be of the same thickness as the second yarns.

A diameter of each first yarn may be e.g., in a range between 0.3 mm and 3.0 mm, preferably in a range between 0.5 mm and 2 mm. The technical effect is to obtain good strength properties as well as good dimensional stability in the travel direction of the belt.

A diameter of each second yarn can be e.g., in a range between 0.3 mm and 3.0 mm, preferably in a range between 1 mm and 2 mm. The technical effect is to obtain good strength properties as well as good dimensional stability in the cross direction of the belt. Thus, the sleeve roll belt can be attached firmly on the sleeve roll.

The second yarns may be arranged to have a depth in a range between 0 and 2 mm, determined from the inner surface of the first yarn to the outer surface of the second yarn.

The first yarns 31 can be arranged into the elastic body 15 of the belt 10. The first yarns 31 can be arranged to a depth in a range between 0 mm and 3.0 mm measured from the outer surface 12 of the belt to an outer surface 31-*o* of the first yarn 31 in the depth direction of the belt. Preferably, the first yarns 31 are arranged to a depth of equal to or more than 0.2 mm, more preferably to a depth of equal to or more than 0.5 mm, and most preferably to a depth of equal to or more than 1.0 mm, measured from the outer surface of the belt to the outer surface 31-*o* of the first yarn 31 in the depth direction of the belt. Said depth may be equal to or less than 2.5 mm, more preferably equal to or less than 2.0 mm, and most preferably equal to or less than 1.5 mm, such as in a range between 0.5 mm and 1.5 mm, measured from the outer surface 12 of the belt to the outer surface 31-*o* of the first yarn 31 in the depth direction of the belt. The technical effect is that the neutral axis of the belt can be near the outer surface of the sleeve roll belt. Thus, in use, a speed difference between the outer surface of the belt, and a surface of a wire which is in contact with the belt may be reduced. Further, a friction between the belt and the wire may be reduced. Thus, the surface wear of the belt as well as the surface wear of the wire may be reduced. If the first yarns 31 are aligned, at least substantially, in the travel direction of the belt and arranged near the outer surface of the belt, it is possible to significantly decrease wearing of the belt as well as wearing of the wire. Thus, the costs caused by the belt may be decreased.

The belt can comprise from 200 to 700 second yarns/m arranged in the second direction and measured perpendicular to the second direction. The number of the second yarns/m is preferably equal to or more than 260 second yarns per meter, more preferably at least 270 second yarns per meter, and most preferably equal to or more than 280 second yarns 32 per meter, arranged in the second direction and measured perpendicular to the second direction. Further, the number of the second yarns is preferably equal to or less than 600 second yarns per meter, more preferably less than 500 second yarns per meter, and most preferably equal to or less than 400 second yarns per meter, arranged in the second direction and measured perpendicular to the second direction. Thus, it is possible to obtain sleeve roll belt having good strength properties as well as good dimensional stability in the cross direction of the belt. Thus, the belt may be firmly fastened to the sleeve roll.

The belt can comprise from 200 to 700 first yarns per meter, arranged in the first direction and measured perpendicular to the first direction. The number of the first yarns is preferably equal to or more than 210 first yarns per meter, more preferably at least 230 first yarns per meter, and most preferably equal to or more than 260 first yarns per meter arranged in the first direction and measured perpendicular to the first direction. Further, the number of the first yarns is preferably equal to or less than 600 first yarns per meter, more preferably less than 500 first yarns per meter, and most preferably equal to or less than 400 first yarns per meter, arranged in the first direction and measured perpendicular to the first direction. Thus, it is possible to obtain good elasticity as well as suitable dimensional stability in the travel direction of the belt.

The yarns may be made of the same material or different materials. The yarns 31, 32, 31*b,c* may comprise monofilament yarns and/or multifilament yarns. Thus, each yarn can be monofilament or multifilament. Monofilament means that there is only one filament per yarn. Multifilament means that there is more than one filament per yarn.

Multifilament structure can have filaments twisted together. Advantageously, the yarns comprise or consist of multifilament yarns. The yarns 31, 32, 31*b,c*, are most preferably multifilament yarns with twist. However, the multifilament structure having filaments twisted together may cause a whole yarn to be broken when the outer surface of the yarn has been damaged. Thanks to the auxiliary yarns, strength properties of the belt may remain at a sufficient level even when outer surfaces of first yarns have been damaged, causing the first yarns losing their strength.

The number of filaments has an effect of the properties of the yarns. Preferably, the yarns are multifilament yarns having from 5 to 10,000 filaments per yarn. The yarns may have equal to or more than 5 filaments per yarn, more preferably equal to or more than 200 filaments per yarn, and most preferably equal to or more than 600 filaments per yarn. Further, the yarns can have equal to or less than 10,000 filaments per yarn, more preferably equal to or less than 4000 filaments per yarn, and most preferably equal to or less than 2000 filaments per yarn.

The yarns may comprise synthetic fibers having high strength, high modulus, and high elastic modulus. The yarns may comprise at least one of

- polyamide (PA), e.g., nylon,
- polypropylene (PP),
- polyethylene (PE), preferably so-called high strength polyethylene,
- rayon,
- viscose,
- polyester, preferably polyethylene terephthalate (PET),
- polyvinyl alcohol (PVA, PVOH),
- polyaramide,
- polyphenylene sulfide (PPS),
- liquid crystal plastic (LCP),
- polyimide,
- carbon fibers, preferably carbon fiber/thermoplastic composite,
- polyethylene naphthalate (PEN), and
- polyether ether ketone (PEEK).

A total amount of said materials is preferably at least 60 wt. %, more preferably at least 80 wt. %, and most preferably at least 95 wt. %, calculated from the total weight of the yarns. Thus, the yarns comprising or consisting of the above-mentioned materials can stiffen the belt but may still allow the necessary level of bending and stretching of the belt. For example, polyester and e.g., polyamide may provide suitable support for the belt. Furthermore, carbon fibers can be used to improve strength of the belt, particularly in the cross direction of the belt. Further, carbon fibers and carbon fiber/thermoplastic composite materials can be used to minimize stretching of the belt in the cross direction.

The specific stress (N/tex) of each first yarn 31 can be e.g., in a range between 0.4 N/tex and 4 N/tex. Thus, it is possible to obtain suitable strength properties in the travel direction of the belt.

A specific stress (N/tex) of each second yarn 32 can be e.g., in a range between 0.5 N/tex and 4 N/tex. N/tex refers to Newton per tex. Thus, it is possible to obtain good strength properties in the cross direction of the belt.

A tensile strength of the second yarns may be higher, preferably at least 4% higher, more preferably at least 8% higher, referred to a unit area of the sleeve roll belt, than the tensile strength of the first yarns.

The sleeve roll belt can have a lighter reinforcing structure in the first direction D1 than in the second direction D2 of the belt, hence, the novel sleeve roll belt can have a high stretchability in the second direction. Therefore, the first yarns and the auxiliary yarns can yield and thus stretch in their longitudinal direction when the sleeve roll belt is bent, for example, on the curve element 110 such that it needs to stretch. However, the reinforcing structure can still be able to control the stretching level of the belt. Thus, the novel sleeve roll belt may not be as easily damaged as a belt could be without the reinforcing structure.

The first yarns, or at least some of the first yarns, may be made of a visually distinctive material, being visually perceptible from the color of the body. Thus, it may be easy to notice the wornness level of the belt so that the belt can be changed before the auxiliary yarns would become damaged.

Auxiliary Yarns

As discussed, the belt comprises auxiliary yarns 31*b*, 31*c*. Thanks to the auxiliary yarns, it is possible to maintain suitable strength for the belt in case the first yarns 31 are harmed. The auxiliary yarns may have a smaller diameter than the first yarns. Therefore, the neutral axis of the belt may not be substantially shifted due to the auxiliary yarns, but surface wear of the belt may be maintained in a reduced level even if the auxiliary yarns are arranged to a depth of greater than a depth of the first yarns.

The auxiliary yarns 31*b*, 31*c* are preferably arranged parallel or at least substantially parallel to the first direction D1. An angle between the auxiliary yarns 31*b,c* and the first direction D1 of the belt is preferably less than 15°, more preferably less than 10°, and most preferably less than 5°. Thus, it can be possible to obtain suitable reinforcing structure for the travel direction of the sleeve roll belt 10 even if the first yarns are broken.

The auxiliary yarns may have greater stretchability than the first yarns, which can reduce their effect on a location of the neutral axis of the belt. The auxiliary yarns 31*b,c* may provide suitable stretchability as well as sufficient strength for the belt in the travel direction of the belt, even if the first yarns are harmed.

The auxiliary yarns 31*b*, 31*c* may be arranged parallel or at least substantially parallel to the travel direction of the belt. An angle between the auxiliary yarns 31*b,c* and the travel direction of the belt may be less than 10°, more preferably less than 5°, and most preferably less than 2°. Thus, it can be possible to obtain suitable reinforcing structure for the travel direction of the sleeve roll belt 10 even if the first yarns are broken. As discussed, the auxiliary yarns 31*b,c* may provide good stretchability as well as sufficient strength for the belt in the travel direction of the belt, even if the first yarns are harmed.

In an embodiment, the angle of the auxiliary yarns with respect to the travel direction, i.e., the direction of rotation of the sleeve roll belt, is advantageously not greater than 2°, such as, for example 0° to 2°, more advantageously not greater than 10, and preferably not greater than 0.5°, such as 0.0° to 0.5°. In this way, auxiliary yarns may be particularly effective when using together with the first yarns.

The auxiliary yarns, or at least some of the auxiliary yarns, may be made of a visually distinctive material being visually perceptible from the color of the body 15 and the first yarns 31. Thus, it may be easy to notice the worness level of the belt so that the belt can be changed before the auxiliary yarns are damaged.

If the first yarns are made of material which is visually perceptible from the color of the body, and the auxiliary yarns are made of material visually perceptible from the color of the body and the first yarns, the wornness level of the belt may be determined more precisely. Furthermore, in this embodiment, the first yarns and the auxiliary yarns may be used as a belt wear indicator. Thus, there may not be a need for any other kind of belt wear indicator.

In an embodiment, the belt comprises

- first auxiliary yarns 31*b* made of material visually perceptible from the color of the body and the first yarns 31,
- second auxiliary yarns 31*c* made of material visually perceptible from the color of the body, the first auxiliary yarns, and the first yarns, and
- optionally, first yarns 31 made of material visually perceptible from the color of the body, and the auxiliary yarns 31*b*, 31*c*.

Thus, in this embodiment, the wornness level of the belt may be determined precisely without any other kind of belt wear indicator.

The auxiliary yarns can be arranged adjacent to each other at a distance from each other. The diameter of the auxiliary yarns as well as material and number of the auxiliary yarns can influence the properties of the sleeve roll belt.

The belt can comprise from 100 to 800 auxiliary yarns per meter, measured perpendicular to the first direction. The number of the auxiliary yarns preferably equal to or more than 200 yarns per meter, more preferably at least 250 yarns per meter, and most preferably equal to or more than 300 yarns per meter, measured perpendicular to the first direction. Further, the number of the auxiliary yarns is preferably equal to or less than 700 yarns per meter, more preferably less than 600 yarns per meter, and most preferably equal to or less than 500 yarns per meter, measured perpendicular to the first direction. Thus, it is possible to obtain good elasticity as well as provide sufficient strength in the travel direction of the belt, even if the first yarns have been broken.

A relative number of the yarns RNY in the belt can be calculated as follows:

$$RNY=N(31)/N(31b+31c)$$

- wherein N(31) refers to number N of the first yarns per meter, and
- N(31*b*+31*c*) refers to number N of the auxiliary yarns per meter.

The relative number of the yarns RNY, i.e., number of the first yarns/m per number of the auxiliary yarns/m can be equal to or more than 0.5, such as in a range between 0.5 and 3, preferably in a range between 1 and 2.5, and most preferably in a range between 1 and 2.

In an embodiment, there is one to three auxiliary yarns between two adjacent first yarns (determined perpendicular to the first direction), and one to three first yarns between two adjacent auxiliary yarns (determined perpendicular to the first direction). Thus, it is possible to obtain sufficient strength properties as well as dimensional stability in the travel direction of the belt, with the first yarns as well as after the first yarns are damaged.

The first yarns and the auxiliary yarns may be either in contact with or bonded to adjacent yarns, or they may be spaced from each other. Preferably, the auxiliary yarns and the first yarns are separated from each other. Thus, the first yarns do not have to be fastened to auxiliary yarns or bound to auxiliary yarns in any way. This may improve strength properties of the belt when the first yarns are damaged.

Each first yarn and each auxiliary yarn can be arranged to be spaced apart by equal, or substantially equal, distances from adjacent yarns.

The adjacent auxiliary yarns may be spaced apart by e.g., from 0.2 to 2 mm, determined perpendicular to the first direction. The auxiliary yarns do not have to be fastened to each other or bound to each other in any way.

The auxiliary yarns may be equal or different in thickness with each other. At least the first auxiliary yarns 31*b* may be substantially equal in thickness with each other. Further, second auxiliary yarns 31*c*, if used, may be substantially equal in thickness with each other. Thus, the auxiliary yarns may comprise yarns having the same diameter with each other, or the diameter may vary.

The auxiliary yarns may comprise or consist of first auxiliary yarns, all first auxiliary yarns having substantially same diameter. The auxiliary yarns may comprise second auxiliary yarns, all second auxiliary yarns having substantially same diameter. The second auxiliary yarns can have different diameter with the first auxiliary yarns.

Figure 4:
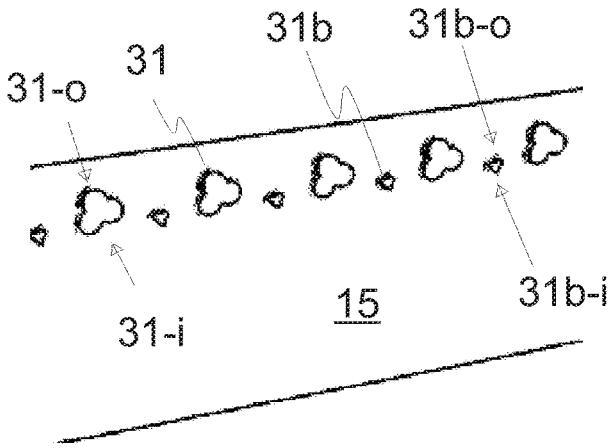
FIG. 4 illustrates an example of an internal structure of a belt.
Figure 3A:
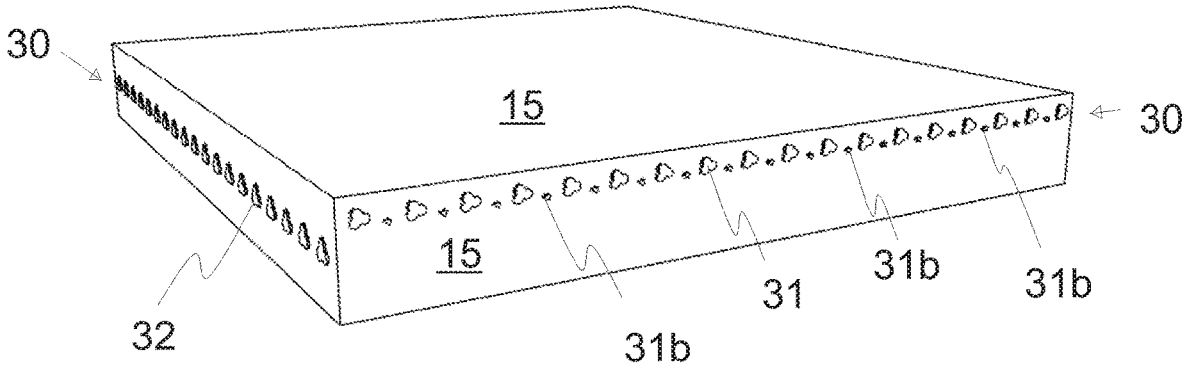
FIGS. 3*a-d* illustrate some examples for internal structures.
Figure 3B:
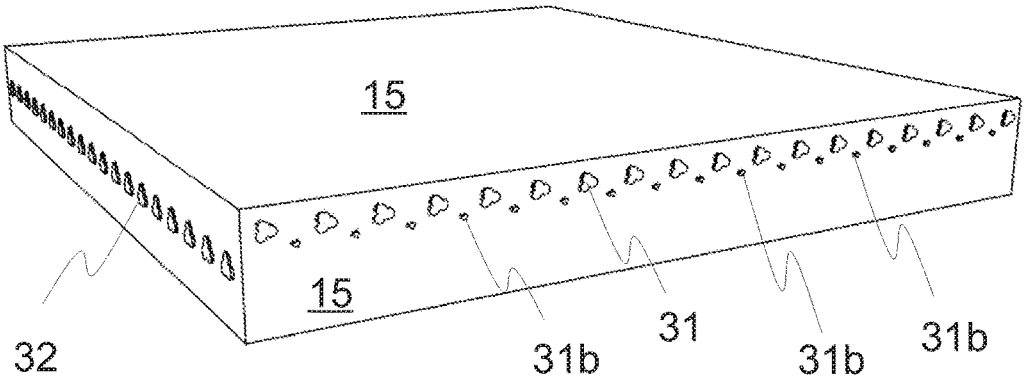
Figure 3C:
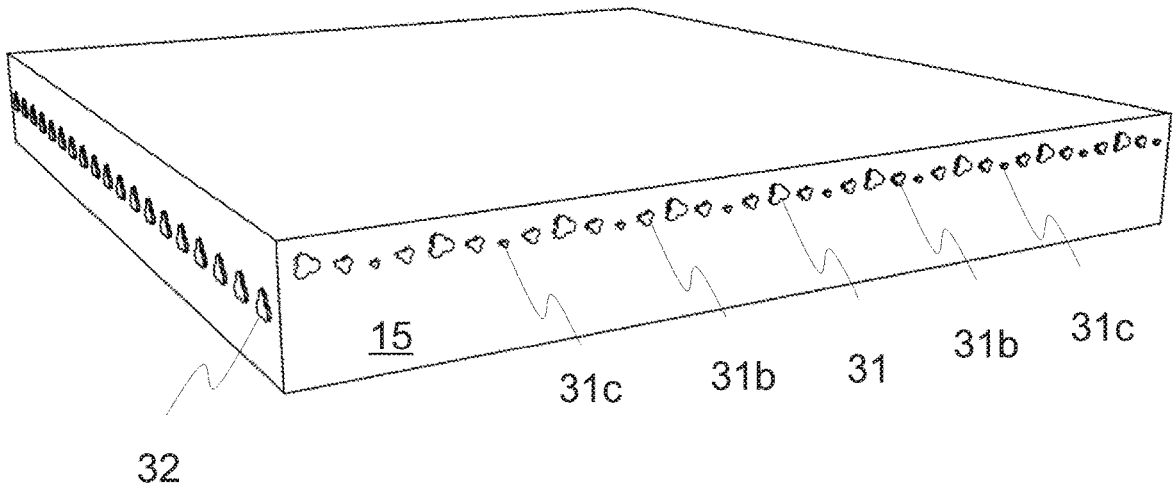
Figure 3D:
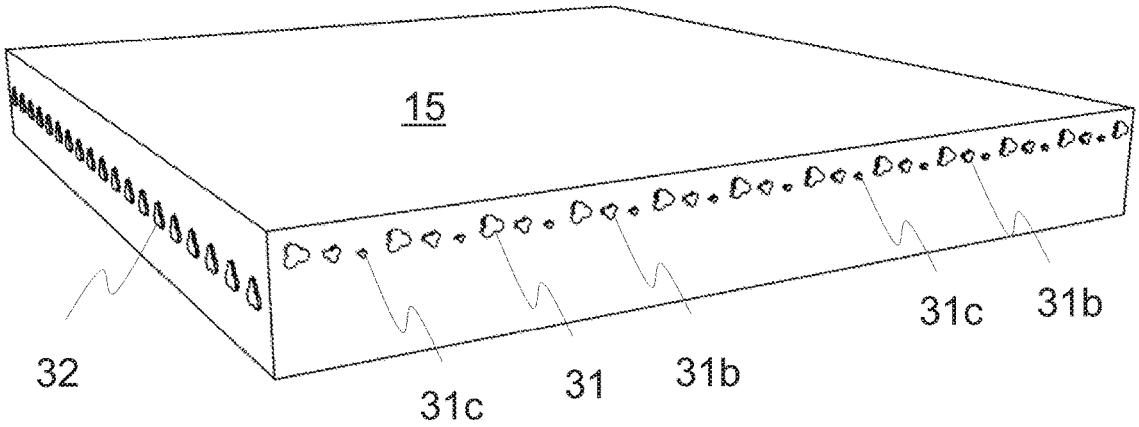

Referring to FIGS. 3*c-d* and 4, the auxiliary yarns 31*b*, 31*c* may comprise or consist of first auxiliary yarns 31*b* and second auxiliary yarns 31*c*, wherein

- all first auxiliary yarns 31*b* have substantially same diameter with each other,
- all second auxiliary yarns 31*c* have substantially same diameter with each other, and
- the first auxiliary yarns 31*b* have a different diameter with the second auxiliary yarns 31*c*.

Thus, the auxiliary yarns, or at least the first auxiliary yarns, can be substantially equal in thickness with each other. Further, the second auxiliary yarns, if used, can be substantially equal in thickness with each other. This can improve controllability of the strength properties as well as controllability of the location of the neutral axis of the belt, particularly when the belt starts to wear.

Referring to FIGS. 3*a-d* and 4, the auxiliary yarns 31*b*, 31*c* can be arranged to a depth of greater than a depth of the first yarns, determined from the outer surface of the belt to an outer surface 31-*o*, 31*b-o* of the yarns in the depth direction of the belt. Preferably, the auxiliary yarns 31*b*, 31*c* are arranged to a depth of at least 10%, more preferably at least 20%, and most preferably at least 30% greater than a depth of the first yarns, determined from the outer surface of the belt to the outer surface 31-*o*, 31*b-o* of said yarns in the depth direction of the belt. Outer surfaces of the auxiliary yarns can be in a depth of greater than outer surfaces of the first yarns, hence, the auxiliary yarns can be able to maintain a strength of the belt in the travel direction of the belt in an acceptable level even if the first yarns are damaged due to wear of the belt. Thus, strength properties of the belt may remain at a sufficient level even when outer surfaces of first yarns have been damaged causing the first yarns losing their strength.

The auxiliary yarns 31*b*, 31*c* can be arranged to a depth of greater than a depth of the first yarns, determined from the outer surface of the belt to an inner surface 31-*i*, 31*b*-*i* of the yarns in the depth direction of the belt. Preferably, the auxiliary yarns 31*b*, 31*c* are arranged to a depth of at least 10%, more preferably at least 20%, and most preferably at least 30% greater than a depth of the first yarns, determined from the outer surface of the belt to the inner surface 31-*i*, 31*b*-*i* of said yarns in the depth direction of the belt. Thus, strength properties of the belt may remain at a sufficient level for longer time, even when the first yarns are totally damaged.

The auxiliary yarns can be arranged into the elastic body to a depth of at least 10% greater than a depth of the first yarns, determined from the outer surface of the belt to central points of the yarns in the depth direction of the belt. More preferably, the auxiliary yarns are arranged into the elastic body to a depth of at least 20% greater than a depth of the first yarns, determined from the outer surface of the belt to central points of the yarns in the depth direction of the belt. Most preferably, the auxiliary yarns are arranged into the elastic body to a depth of at least 30% greater than a depth of the first yarns, determined from the outer surface of the belt to central points of the yarns in the depth direction of the belt. If the auxiliary yarns are further arranged into said depth, the auxiliary yarns may be able to provide sufficient strength for the belt after the first yarns are damaged.

The auxiliary yarns can be arranged to a depth of equal to or more than 0.1 mm, more preferably to a depth of equal to or more than 0.2 mm, and most preferably to a depth of equal to or more than 0.4 mm, measured from the outer surface 31-*o* of the first yarn to the outer surface 31*b*-*o* of the auxiliary yarn, in the depth direction of the belt. Further, auxiliary yarns can be arranged to a depth of equal to or less than 2 mm, more preferably to a depth of equal to or less than 1.5 mm, and most preferably to a depth of equal to or less than 1 mm, measured from the outer surface 31-*o* of the first yarn to the outer surface 31*b*-*o* of the auxiliary yarn, in the depth direction of the belt. Thus, the auxiliary yarns may not be too far from the outer surface of the belt, hence, the neutral axis of the belt may remain near the outer surface of the sleeve roll belt. Furthermore, the auxiliary yarns may be able to maintain a strength of the belt at certain level if the first yarns cannot maintain the strength due to e.g., damage caused by wear of the belt.

Further, in order to control the neutral axis of the belt, the auxiliary yarns can be arranged into the elastic body so that the whole auxiliary yarn is in a depth of less than a depth of the second yarns, determined in the depth direction of the belt.

By arranging the neutral axis of the belt to be near the outer surface of the belt, the outer surface 12 of the belt can wear less, and the inner surface 11 of the belt may wear more. However, this may not cause problems to the belt, because there is typically a lubricant layer, such as an oil layer, between the outer surface of the sleeve roll 100 and the inner surface 11 of the belt. Thus, the friction between the belt and the sleeve roll is typically very low. Therefore, the inner surface of the belt may not wear much even if the neutral axis of the belt is near the outer surface of the belt.

In order to maintain the neutral axis of the belt near the outer surface of the belt, the auxiliary yarns 31*b*, 31*c* are preferably thinner than the first yarns 31. Thus, diameter of the auxiliary yarns is preferably smaller than diameter of the first yarns. Further, the auxiliary yarns can be thinner than the second yarns 32.

The auxiliary yarns 31*b*, 31*c* can be at least 20% thinner than the first yarns, preferably equal to or more than 30% thinner than the first yarns 31, more preferably equal to or more than 40% thinner than the first yarns 31, and most preferably equal to or more than 50% thinner than the first yarns 31, for example from 30% to 70% thinner than the first yarns 31, determined from the diameter of the yarns. In this way, it may be possible to obtain suitable strength properties on the travel direction of the sleeve roll belt, even if the first yarns are harmed, while (substantially) maintaining a location of the neutral axis of the belt. Thus, diameters of the auxiliary yarns can be substantially smaller than a diameter of the first yarns, hence, the wear level of the belt (and a wire) may be maintained at a suitable level in use. Still further, thanks to the decreased diameter, the auxiliary yarns can be cost-efficient, environmentally friendly solution.

A diameter of the auxiliary yarns may be in a range between 0.1 mm and 1.5 mm. The diameter of the auxiliary yarns is preferably equal to or less than 1.2 mm, more preferably equal to or less than 1.0 mm, and most preferably equal to or less than 0.9 mm. Further, the diameter of the auxiliary yarns is preferably equal to or more than 0.1 mm, more preferably equal to or more than 0.2 mm and most preferably equal to or more than 0.3 mm. The technical effect is to obtain sufficient strength properties on the travel direction of the sleeve roll belt, even when the first yarns are harmed, without affecting too much to a location of the neutral axis of the belt.

Referring to FIGS. 3*c* and 3*d*, the belt may comprise first auxiliary yarns and second auxiliary yarns.

A diameter of the second auxiliary yarns, if used, may be 10%-90%, preferably 20% to 80%, determined from the diameter of the first auxiliary yarns. In this embodiment, the second auxiliary yarns are preferably in a depth greater than a depth of the first auxiliary yarns, determined from outer surfaces of each yarn. The technical effect is to obtain sufficient strength properties on the travel direction of the sleeve roll belt, even when some of the first auxiliary yarns are harmed, without affecting too much to a location of the neutral axis of the belt. Further, if the yarns are made of material visually perceptible from the color of the body and the first yarns, the wornness level of the belt may be determined without any other kind of belt wear indicator.

The auxiliary yarns 31*b*, 31*c* are preferably multifilament yarns with twist. Preferably, the auxiliary yarns are multifilament yarns having from 20 to 2000 filaments per yarn. The auxiliary yarns may have equal to or more than 60 filaments per yarn, more preferably equal to or more than 100 filaments per yarn, and most preferably equal to or more than 200 filaments per yarn. Further, the auxiliary yarns can have equal to or less than 1500 filaments per yarn, more preferably equal to or less than 1000 filaments per yarn, and most preferably equal to or less than 700 filaments per yarn. This may improve strength properties of the belt, particularly after the first yarns have been damaged, without affecting too much to the location of the neutral axis of the belt.

As discussed, the sleeve roll belt 10 may be subjected to high stresses when it is stretched and bended with small radius on the curve element 110 of the sleeve roll. Thus, the auxiliary yarns may be made from elastic material(s). The elastic material(s) may allow the sleeve roll belt to bend at a certain radius of curvature, in a manner helping its passage on the surface 110*a*, 110*b* of the curve element. The first yarns and the auxiliary yarns may have a greater stretchability, e.g., at least 4% greater, more preferably at least 8% greater, than second yarns. Thus, the belt can be configured to stretch easily on the curve element of the sleeve roll.

The auxiliary yarns may comprise or consist of at least one of the following materials:

- polyamide (PA), for example nylon,
- polypropylene (PP),
- polyethylene (PE), preferably so-called high strength polyethylene,
- rayon,
- viscose,
- polyester, preferably polyethylene terephthalate (PET),
- polyvinyl alcohol (PVA, PVOH),
- polyaramide,
- polyphenylene sulfide (PPS),
- liquid crystal plastic (LCP),
- polyimide,
- carbon fibers, preferably carbon fiber/thermoplastic composite,
- polyethylene naphthalate (PEN), and
- polyether ether ketone (PEEK).

These materials can be used to provide sufficient strength properties and dimensional stability for the auxiliary yarns. If the auxiliary yarns comprise carbon fiber composites, the belt may not, in some cases, stretch as much as with some other materials. However, carbon fiber composites can improve strength of the belt.

Preferably, the auxiliary yarns can comprise or consist of at least one of

- polyamide (PA),
- aromatic polyamide,
- polyester, preferably polyethylene terephthalate (PET),
- polyethylene naphthalate (PEN),
- rayon, and
- carbon/thermoplastic composite.

These materials can be used to provide improved strength properties and dimensional stability for the auxiliary yarns More preferably, the auxiliary yarns comprise or consist of

- polyester, preferably polyethylene terephthalate (PET), polyethylene naphthalate (PEN), and
- rayon.

These materials can be used to provide improved combination of stretchability and dimensional stability for the auxiliary yarns Most preferably, the auxiliary yarns comprise or consist of polyester. Thus, strength, stretchability and dimensional stability of the auxiliary yarns can be improved cost efficiently.

For environmental reasons, the auxiliary yarns can comprise or be made of biopolymer(s) and/or the auxiliary yarns can comprise or be made of recycled polymer(s).

In an embodiment, the auxiliary yarns comprise or are made of recycled and/or bio-based polyester and/or polyamide. Thus, the auxiliary yarns may be made of e.g., bio-based polyamide.

The auxiliary yarns can be more elastically flexible than the first yarns. Further, the auxiliary yarns can be thinner than the first yarns.

A specific stress (N/tex) of each auxiliary yarn 31*b*, 31*c* can be e.g., in a range between 0.3 N/tex and 4 N/tex. Thus, it is possible to obtain suitable strength properties in the travel direction of the belt, even if the first yarns are harmed.

A tensile strength of the first yarns may be higher, preferably at least 10% higher, more preferably at least 15% higher, referred to a unit area of the sleeve roll belt, than the tensile strength of the auxiliary yarns. Thus, the auxiliary yarns may not affect much to a location of the neutral axis of the belt.

Thanks to the sleeve roll belt, a radius of curvature on a curve element 110 of the sleeve roll 100 can be smaller than conventionally. Hence, it may be possible to use such curve elements which can cause a very small radius of curvature to the belt. This may improve the effectiveness of the sleeve roll 100.

Furthermore, thanks to the novel solution, auxiliary yarns can be arranged into the belt so that strength of the belt may be maintained in an acceptable level even if the first yarns are damaged. The auxiliary yarns may not affect too much to the neutral axis of the belt and, hence, the wear level of the belt (and a wire) may be maintained at a suitable level despite of the auxiliary yarns.

Furthermore, thanks to the auxiliary yarns, the first yarns may also have a quite small diameter, which may improve stretching of the belt in the travel direction of the belt. In this case, due to the improved stretching properties of the belt, a curve element 110 of a sleeve roll may be used in such a manner that a higher water removal rate may be obtained.

The benefits are typically realized the better, the more of preferred features are implemented in the sleeve roll belt 10.

The invention has been described with the aid of illustrations and examples. The invention is not limited solely to the above presented embodiments but may be modified within the scope of the appended claims.

I claim:

1. A sleeve roll belt for a sleeve roll in a forming section of a fiber web machine, the sleeve roll belt comprising:

a body forming an endless loop which is arranged to rotate in a machine direction about an axis which extends in a cross-machine direction and having an inner belt surface arranged to face a sleeve roll, an outer belt surface arranged to face a fiber web, and the body defining a thickness between the inner belt surface and the outer belt surface, and a depth from the outer belt surface to the inner belt surface;

a reinforcing structure within the body of the sleeve roll belt, the reinforcing structure comprising:

first yarns having a first diameter, a first outermost surface and a first innermost surface, wherein the first yarns are arranged substantially in the machine direction;

auxiliary yarns having a second diameter, a second outer surface and a second inner surface, wherein the auxiliary yarns are arranged substantially parallel to the machine direction;

second yarns arranged substantially in the cross-machine direction, wherein the second yarns are spaced below the first yarns and the auxiliary yarns;

wherein the first yarns are arranged at a first depth measured from the outer belt surface to the first outer surface of said first yarns;

wherein the auxiliary yarns are arranged to a second depth measured from the outer belt surface to the second outer surface;

and wherein the second diameter of the auxiliary yarns is at least 20% smaller than the first diameter of the first yarns.

2. The sleeve roll belt of claim 1 wherein the second depth is at least 10% greater than the first depth.

3. The sleeve roll belt of claim 2 wherein each auxiliary yarn is spaced in the cross-machine direction between two of the first yarns.

4. The sleeve roll belt of claim 1 wherein the reinforcing structure within the body of the sleeve roll belt further comprises second auxiliary yarns, the second auxiliary yarns each having a third diameter, a third outer surface and a third inner surface, wherein the second auxiliary yarns are arranged substantially parallel to the machine direction.

5. The sleeve roll belt of claim 4 wherein the third diameter of the second auxiliary yarns is 10-90% of the second diameter of the auxiliary yarns.

6. The sleeve roll belt of claim 5 wherein the third diameter of the second auxiliary yarns is 20-80% of the second diameter of the auxiliary yarns.

7. The sleeve roll belt of claim 4 wherein the second auxiliary yarns are arranged at a third depth measured from the belt outer surface to the second auxiliary yarns wherein the third depth is greater than the second depth.

8. The sleeve roll belt of claim 4 wherein the auxiliary yarns and the second auxiliary yarns are arranged to a depth that is at least 10% greater than the first depth.

9. The sleeve roll belt of claim 4 wherein at least some of the auxiliary yarns or second auxiliary yarns are made of material that is visually perceptible as different from colors of the body and the first yarns.

10. The sleeve roll belt of claim 4 wherein the diameter of the auxiliary yarns or second auxiliary yarns is between 0.1 mm and 1 mm.

11. The sleeve roll belt of claim 4 wherein a number of the auxiliary yarns and the second auxiliary yarns measured in the cross-machine direction is between 200 yarns/m and 600 yarns/m.

12. The sleeve roll belt of claim 4 wherein a number of the auxiliary yarns and the second auxiliary yarns per meter is between 0.5 and 3 times that of the first yarns per meter, measured in the cross-machine direction.

13. The sleeve roll belt of claim 4 wherein the auxiliary yarns and the second auxiliary yarns are arranged at a depth of between 2 mm and the first depth of the first yarns.

14. The sleeve roll belt of claim 4 wherein the auxiliary yarns and the secondary auxiliary yarns are of a material selected from the group consisting of polyamide, aromatic polyamide, rayon, polyester, polyethylene terephthalate, polyethylene naphthalate, and carbon/thermoplastic composite.

15. The sleeve roll belt of claim 1 wherein the diameter of the first yarns is between 0.3 mm and 3 mm.

16. The sleeve roll belt of claim 1 wherein the diameter of the second yarns is in a range between 0.3 mm and 3 mm.

17. The sleeve roll belt of claim 1 wherein the sleeve roll belt has at least one property selected from the group consisting of:

wherein the sleeve roll belt is configured to stretch elastically at least 1.5% in the machine direction, so that it will return to its original length after forces stretching the belt have been removed;

a load at specific elongation of 2% (LASE 2%) in the travel direction of the sleeve roll belt is between 28 kN/m and 50 kN/m;

a load at specific elongation of 4% (LASE 4%) in the travel direction of the belt is between 49 kN/m and 80 kN/m;

the belt is configured to return to its original length after a load of 25-30 kN/m stretching the belt in the travel direction of the belt has been removed; and the sleeve roll belt has a tensile elongation at break of between 20%, and 25%, measured at a temperature of 20° C. in the machine direction.

18. The sleeve roll belt of claim 1 wherein the second depth is not greater than the first depth, such that the auxiliary yarns do not extend below the first yarns.

19. A sleeve roll apparatus for a forming section of a fiber web machine comprising:

a sleeve roll having a protruding curve element thereon;

a sleeve roll belt mounted to the sleeve roll to extend over the curve element, the sleeve roll belt comprising:

a body forming an endless loop which is arranged to rotate in a machine direction about an axis which extends in a cross-machine direction and having an inner belt surface arranged to face a sleeve roll, an outer belt surface arranged to face a fiber web, and the body defining a thickness between the inner belt surface and the outer belt surface, and a depth from the outer belt surface to the inner belt surface;

a reinforcing structure within the body of the sleeve roll belt which comprises:

first yarns having a first diameter, a first outermost surface, and a first innermost surface, and wherein the first yarns are arranged substantially in the machine direction;

auxiliary yarns having a second diameter, a second outer surface, and a second inner surface, wherein the auxiliary yarns are arranged substantially parallel to the machine direction;

second yarns arranged substantially in the cross-machine direction and spaced from the belt outer surface to be below the first yarns and the auxiliary yarns;

wherein the first yarns are arranged beneath the belt outer surface, wherein the innermost surfaces of the first yarns are spaced a first distance below the belt outer surface;

wherein the auxiliary yarns are arranged to a second depth measured from the outer belt surface to the second outer surface, and wherein the second depth is not greater than the first distance; and wherein the second diameter of the auxiliary yarns is at least 20% smaller than the first diameter of the first yarns.

20. The sleeve roll apparatus of claim 19 wherein each auxiliary yarn is spaced in the cross-machine direction between two of the first yarns.

* * * * *